US005161609A

United States Patent [19]

Dutertre et al.

[11] Patent Number: 5,161,609

[45] Date of Patent: Nov. 10, 1992

[54] METHOD AND APPARATUS FOR HIGH SPEED REGULATION OF A WALL TEMPERATURE

[75] Inventors: Bernard Dutertre, Neuilly; Frederic Dufau, La-Celle-Saint-Cloud; Dominique Duval, Versailles; Frederic Ginot, Paris; Jean Hache, Voisins-le-Bretonneux; Daniel Cohen, Saint-Mande; Agnes Marcadet-Troton, Paris, all of France

[73] Assignee: Bertin & Cie, Plaisir, France

[21] Appl. No.: 576,457

[22] PCT Filed: Jan. 19, 1990

[86] PCT No.: PCT/FR90/00042

§ 371 Date: Sep. 18, 1990

§ 102(e) Date: Sep. 18, 1990

[87] PCT Pub. No.: WO90/08298

PCT Pub. Date: Jul. 26, 1990

[30] Foreign Application Priority Data

Jan. 20, 1989 [FR] France ..... 89 00681

[51] Int. Cl.[5] ..... F28D 15/02; F28F 27/00

[52] U.S. Cl. ..... 165/32; 165/96; 165/61; 165/104.26; 165/104.21; 165/48.1; 435/289

[58] Field of Search ..... 165/104.26, 104.21, 165/32, 96, 61, 48, 47; 435/289

[56] References Cited

U.S. PATENT DOCUMENTS

| | | | |
|---|---|---|---|
| 2,363,118 | 11/1944 | Chamberlain | 165/104.21 |
| 3,327,772 | 6/1967 | Kodaira | 165/32 |
| 3,603,767 | 9/1971 | Scicchitano | 165/104.26 |
| 3,714,981 | 2/1973 | Noren . | |
| 3,934,643 | 1/1976 | Laing | 165/32 |
| 3,943,964 | 3/1976 | Asselman et al. | 165/104.26 |
| 3,968,787 | 7/1976 | Basiulis | 165/104.26 |
| 4,095,647 | 6/1978 | Asselman et al. | 165/104.26 |
| 4,136,733 | 1/1979 | Asselman et al. | 165/32 |
| 4,246,955 | 1/1981 | Skala | 165/104.26 |
| 4,370,547 | 1/1983 | Ward | 165/32 |
| 4,387,762 | 6/1983 | Rinderle | 165/96 |
| 4,679,615 | 7/1987 | Livne | 165/58 |
| 4,911,230 | 3/1990 | Mayer et al. | 165/61 |

FOREIGN PATENT DOCUMENTS

| | | |
|---|---|---|
| 212473 | 3/1987 | European Pat. Off. . |
| 2193187 | 2/1974 | France . |
| 519149 | 3/1972 | Switzerland . |

*Primary Examiner*—Albert W. Davis, Jr.
*Attorney, Agent, or Firm*—Bell, Seltzer, Park & Gibson

[57] ABSTRACT

A method and apparatus for high speed temperature regulation of elements (12) in thermal contact with a fluid contained in liquid-vapor equilibrium inside an enclosure (10) which is closed in sealed manner and which is provided with thermal insulation, temperature regulation being provided by means of an external heat source (S) imposing a reference temperature (Tc) to the fluid contained inside the enclosure (10) and causing a corresponding variation in the temperature (Te) of the elements (12) by changing the phase of the fluid. The invention is particularly applicable to performing molecular biology reactions at controlled temperature.

16 Claims, 2 Drawing Sheets

METHOD AND APPARATUS FOR HIGH SPEED REGULATION OF A WALL TEMPERATURE

The invention relates to a method and to apparatus for high speed regulation of the temperature of a plurality of wall zones, and also to applications of said method and said apparatus, in particular to operations in molecular biology including controlled temperature reactions such as operations in which DNA is treated by enzymes, for example.

Some of these operations require samples of cells or macromolecules to be subjected to thermal cycles including temperature levels each of which is determined very accurately both in duration and in temperature ($\delta T < 0.1°$ C.). In some cases, these temperature cycles need to be repeated many times.

For reasons of yield, it is also desirable to perform these operations simultaneously on a large number of samples. It is then necessary to be able to control the temperature of a large number of samples very accurately as a function of time, and to cause the temperature of these samples to vary uniformly, with the transitions between temperature levels being performed as quickly as possible so that the total duration of a given operation is compatible with industrial application (where the durations of the biological reactions per se cannot be reduced).

A particular object of the present invention is to provide a method and an apparatus for high speed regulation of a temperature, and enabling the conditions specified above to be satisfied.

Another object of the invention is to provide a method and an apparatus of this type which are particularly suitable for performing operations of the above-mentioned type in molecular biology, said operations being performed simultaneously on a large number of biological samples.

Another object of the invention is to provide a method and an apparatus of this type suitable for other applications in which the temperature of an item or a set of items is to be varied quickly and accurately, as happens, for example, in controlled wall temperature reactors, enzyme reactors, cellular reactors, polymerization reactors, the treatment or transformation of plastic materials, in photography (film processing), etc.

The invention therefore proposes a method of high speed temperature regulation of a plurality of wall zones, in particular of receptacles containing biological samples, for the purpose of subjecting them simultaneously to identical thermal cycles including successive stages of predetermined temperatures and durations, the stages being separated by sudden transitions, the method being characterized in that said wall zones are surrounded by a sealed closed enclosure containing a fluid which is suitable for heat transfer in liquid-vapor equilibrium and which is in thermal contact with said wall zones, said enclosure firstly enabling the vapor phase of the fluid to flow freely and secondly including an internal lining for capillary flow of the liquid phase of the fluid, and in that heat is taken from and given to said fluid by means of thermal exchange with at least one external source, thereby maintaining the temperature of said wall zones equal to a variable reference temperature by local condensation and vaporization of the fluid inside said enclosure, the variable reference temperature being imposed by the source.

The invention constitutes a novel and inventive particular application of the "heat pipe" technique which was used initially in space applications for quickly removing a large quantity of heat produced by an item that gives off heat, and in general this is constituted by the electronics package on board a satellite. A heat pipe is essentially a closed tube containing an internal coating of porous material for liquid capillary flow, and a determined fluid which remains in the liquid-vapor two-phase state inside the tube under the intended operating conditions. One of the two ends of the tube is connected to the item that gives off heat, and the other is connected to a surface that dumps heat to the outside by radiating it. Heat is transferred between the item that gives off heat and the outside within the heat pipe by the fluid changing phase, with the fluid continuously vaporizing in the vicinity of the hot item and continuously condensing in the vicinity of the surface for diffusion to the outside, with the coating of capillary material providing continuous and quasi-instantaneous transfer of liquid from the cold end to the hot end of the heat pipe. The thermal conductivity of a heat pipe is very high, several orders of magnitude higher than that of copper, for example.

The invention uses this known principle, not for continuously removing a large quantity of heat from a hot item to a cold outside environment, but to perform temperature-varying cycles accurately and quasi-instantaneously on walls that are in contact with an appropriate fluid. More particularly, the invention makes it possible to heat and to cool at will and quasi-instantaneously samples that are in thermal contact with an appropriate fluid in two-phase liquid-vapor equilibrium, and to maintain these samples at an accurate temperature throughout a determined length of time.

In other words, the invention uses the same means to maintain a temperature at a predetermined value and to cause this temperature to change suddenly to another predetermined value by virtue of the fact that the means used offers either substantially infinite thermal inertia relative to the outside (thereby enabling it to maintain the predetermined accurate temperature and protect it from the influence of interfering phenomena), or else substantially zero thermal inertia (which enables the temperature to be changed very quickly to some other predetermined value).

According to another characteristic of the invention, the method also consists in determining the total mass and the nature of the fluid as a function of the volume of the enclosure in such a manner that liquid-vapor equilibrium of the fluid and impregnation of the coating by the fluid in the liquid phase are maintained for all temperatures lying within a predetermined range of reference temperatures.

When the method of the invention is used for operations in molecular biology, where the temperature of a sample may vary over a determined cycle between extreme values of about 0° C. and about 100° C., for example, the invention makes it possible to vary the temperature of the samples subjected to these reactions quasi-instantaneously, to take up any value lying between the above-mentioned extreme values.

The heat source used may be of the reversible type enabling the reference temperature of the fluid to be selectively increased and decreased, or else it may comprise two switchable heat sources, one for increasing the reference temperature of the fluid and the other for decreasing it.

In a variant, the external energy source may comprise means for varying the vapor pressure of the fluid inside the enclosure.

By varying the vapor pressure of the fluid inside the enclosure, it is possible either to raise the temperature of the fluid (vapor phase compression), or else to reduce this temperature (vapor phase expansion). So long as the temperature and the pressure of the fluid are accurately calibrated and detected, it is possible to determine the reference temperature of the fluid by conventional pressure varying means, e.g. of the deformable wall type.

When the invention is applied to molecular biology reactions, the items whose temperature is to be regulated may be tubes provided with filter membranes and containing biological samples such as cells or macromolecules, and the method of the invention then consists in combining cyclical temperature variations with the addition of reagents and with pressure variations inside the tubes, e.g. for DNA treatment.

In this case, the durations of transitions between predetermined temperature levels become substantially negligible compared with the total accumulated durations of these biological reactions themselves.

The invention also provides apparatus for high speed temperature regulation of a plurality of wall zones, in particular receptacles containing biological samples, for the purpose of subjecting them simultaneously to identical thermal cycles including successive stages of predetermined temperatures and durations, the stages being separated by sudden transitions, the apparatus being characterized in that it comprises a sealed closed enclosure containing a fluid suitable for transferring heat in liquid-vapor equilibrium and in thermal contact with said wall zones, said closed enclosure enabling the vapor phase of the fluid to flow freely and including an internal lining for capillary flow of the liquid phase of the fluid, the apparatus also including at least one external source in thermal exchange with the fluid, and means for controlling said source to take heat from and to deliver heat to said fluid in order to maintain the temperature of said wall zones equal to a variable reference temperature by local condensation and vaporization of the fluid contained in said enclosure, the reference temperature being imposed by the source.

In one embodiment of the apparatus, applicable to reactions in molecular biology in particular, the enclosure includes parallel passages opening out to the outside and forming receptacles or housings for tubes in which biological samples such as cells or macromolecules are placed.

The walls of these passages form the means for transferring heat by conduction between the contents of the receptacles or the tubes and the fluid contained in the enclosure, while the walls of the enclosure to which the ends of the passages open out are covered in sealed manner by caps associated with means for putting the contents of the receptacles or the tubes under increased or decreased pressure.

The tubes are preferably carried at one end by a common transverse plate for application against a wall of the enclosure when the tubes are housed in the passages of the enclosure.

It is thus possible simultaneously to treat a very large number of tubes each containing a biological sample.

The invention will be better understood and other details, characteristics, and advantages thereof appear more clearly on reading the following description made by way of example and with reference to the accompanying drawings, in which.

Figure 1:
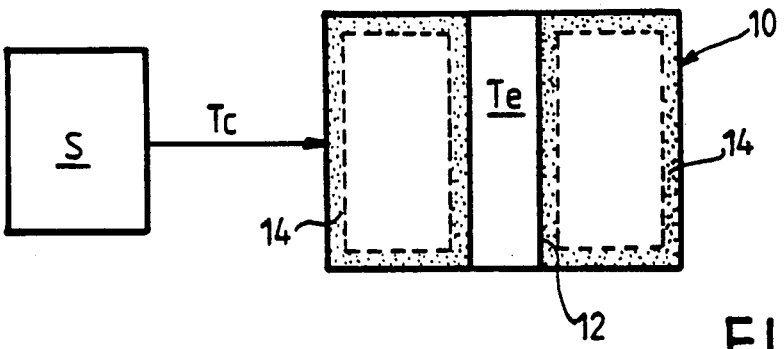
FIG. 1 is a block diagram of the invention.

Reference is made initially to FIG. 1 to explain the principle of the invention.

Reference 10 designates a closed sealed enclosure which is preferably thermally insulated, at least locally, the enclosure comprising a wall 12, e.g. a tubular wall, whose temperature is to be varied. The wall 12 is in contact with a fluid enclosed inside the enclosure 10 and which is in liquid-vapor equilibrium for all values over which the temperature of the wall 12 is to be varied. The liquid phase fluid completely impregnates a coating 14 of porous or fibrous material, for example, and suitable for ensuring capillary flow of the liquid, this coating lining the enclosure 10 and the wall 12 and providing continuous capillary paths for the liquid between the wall 12 and a peripheral portion of the wall of the enclosure 10.

This peripheral wall of the enclosure is in thermal contact with an external energy source S such as a reversible type heat source (e.g. a Peltier effect or a fluid flow source). This source S is intended to set a reference temperature Tc for the fluid in liquid-vapor equilibrium inside the enclosure 10, such that the temperature Te of the wall 12 becomes equal to the reference temperature Tc as quickly as possible. When the reference temperature Tc is greater than the temperature of the fluid, then a portion of the fluid that was in the liquid phase in the zone in thermal contact with the external heat source S is vaporized locally, thereby increasing the pressure inside the enclosure 10. Since the liquid-vapor equilibrium temperature varies directly with pressure, the above-mentioned increase in pressure gives rise to an increase in the value of the liquid-vapor equilibrium temperature within the enclosure. This temperature becomes higher than the temperature of the wall 12, thereby causing the fluid to condense locally. Such condensation gives rise to heat being given off, with the fluid delivering its latent heat of condensation to the cold portions of the enclosure. If the enclosure 10 is provided with suitable thermal insulation, then the only available cold source is the wall 12 which therefore receives the latent heat of condensation of the condensed portion of the fluid. This application of heat gives rise to an increase in the temperature Te of the wall 12.

This two-part phenomenon of local vaporization of the fluid in the zone which is in thermal contact with the external heat source S, and of local condensation in the zone which is in contact with the wall 12 gives rise to a capillary flow of liquid from the wall 12 to the zone in contact with the source S, and this continues until temperature equilibrium is obtained with Tc=Te. Since the latent heat of condensation of the fluid is much higher than its specific heat for the temperature variations under consideration, the increase in temperature of the wall 12 is quasi-instantaneous. Temperature regulation is, in fact, slowed down by the transfer of heat through the wall of the enclosure 10.

Conversely, when it is desired to reduce the temperature of the wall 12 relative to the equilibrium temperature, the reference temperature Tc is reduced to the desired value, thereby causing the fluid to condense locally inside the enclosure 10, thus reducing the pressure inside the enclosure and consequently reducing the liquid-vapor equilibrium temperature of the fluid and thus giving rise to vaporization of the liquid in the vicinity of the wall 12. By vaporizing, the liquid takes its latent heat of vaporization from the wall 12 which is the only available heat source. The temperature of the wall 12 therefore drops until it becomes equal to the reference temperature Tc, by virtue of the fluid being transferred in the liquid phase by the capillary coating of the enclosure 10 between its zones which are in thermal contact with the source S and with the wall 12.

An appropriate choice of material improves the transfer of heat by conduction between the fluid contained in the enclosure 10, the wall 12, and the external heat source S. The means providing a thermal connection between the enclosure 10 and the heat source may also be of the heat pipe type if necessary, and they may optionally be shaped to receive a plurality of enclosures simultaneously.

Naturally, instead of using a reversible type heat source S, it would be possible selectively to use an external hot source and an external cold source, with one being used to increase the reference temperature and the other to decrease it.

In a variant, it is also possible to replace the external heat source by appropriate means for varying the vapor pressure of the fluid inside the enclosure 10. This pressure variation may be achieved either by injecting fluid under pressure into the enclosure or else by reducing the volume of the enclosure by means of a moving wall or by means of an elastically deformable membrane type wall.

In any event, an external energy source S makes it possible to vary the temperature of the wall 12 quickly and quasi-instantaneously by changing the phase of the fluid contained inside the enclosure 10.

The enclosure 10 also makes it possible to maintain the temperature of the wall 12 at a reference value set by the source S. Any variation in the temperature of the wall 12 that could be due, for example, to heat being given off or absorbed by a chemical reaction is immediately and automatically compensated by the enclosure 10 which also protects the wall 12 from external interfering influences.

Figure 2:
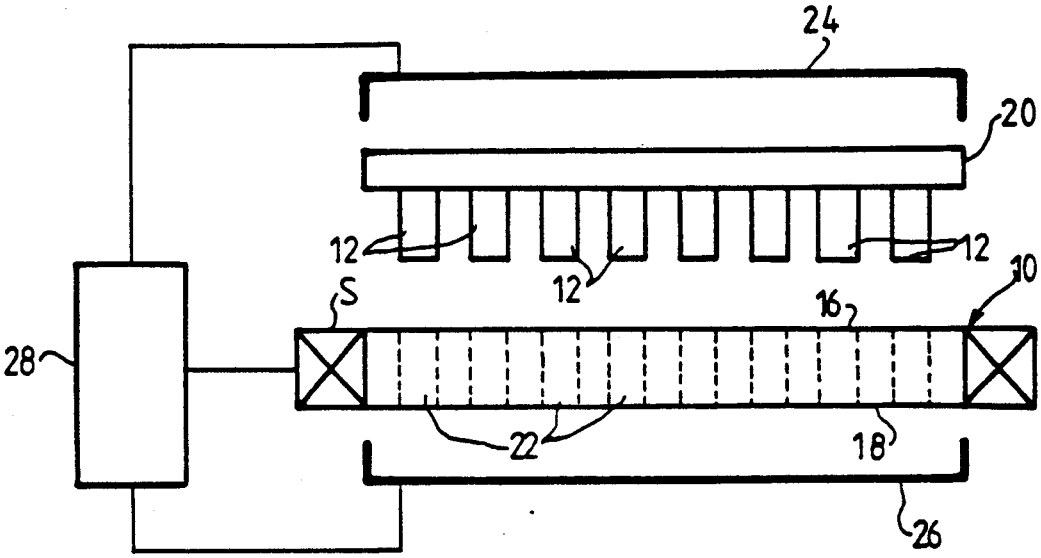
FIG. 2 is a diagram of apparatus in accordance with the invention for operations in molecular biology.

FIG. 2 shows apparatus which applies the principle of the invention. In order to facilitate understanding, the same references are used in FIG. 2 as in FIG. 1 for those items of the apparatus which correspond to items shown in FIG. 1.

Thus, FIG. 2 has an enclosure 10 which is closed in sealed manner and which contains an appropriate fluid in liquid-vapor two-phase equilibrium, together with an internal lining ensuring capillary flow of the liquid phase of the fluid, with the enclosure having passages formed therein for receiving items whose temperature is to be regulated. The external heat source S is in thermal contact by conduction with the peripheral wall of the enclosure 10, and the top and bottom transverse walls 16 and 18 of the enclosure are provided with thermal insulation.

The items whose temperature is to be regulated are tubes 12 carried on a common plate 20 and intended to be engaged in parallel passages 22 passing through the enclosure 10 and shaped so as to receive the tubes 12, establishing good thermal contact therewith. To do this, the outside surfaces of the tubes 12 may be slightly frustoconical, with the inside surfaces of the passages 22 having a corresponding shape.

In this case, the tubes 12 are open at both ends, with their top ends opening out to the top face of the plate 20. Respective caps 24 and 26 are provided for closing in sealed manner the plate 20 carrying the tubes 12 and the bottom face 18 of the enclosure 10. These caps 24, 26 are connected to means 28 for controlling the pressure applied to each of the two ends of the tubes 12, on opposite sides of a filter membrane mounted transversely inside each tube 12.

The means 28 also control the operation of the external energy source S for regulating the temperature inside the tubes 12.

Figure 3:
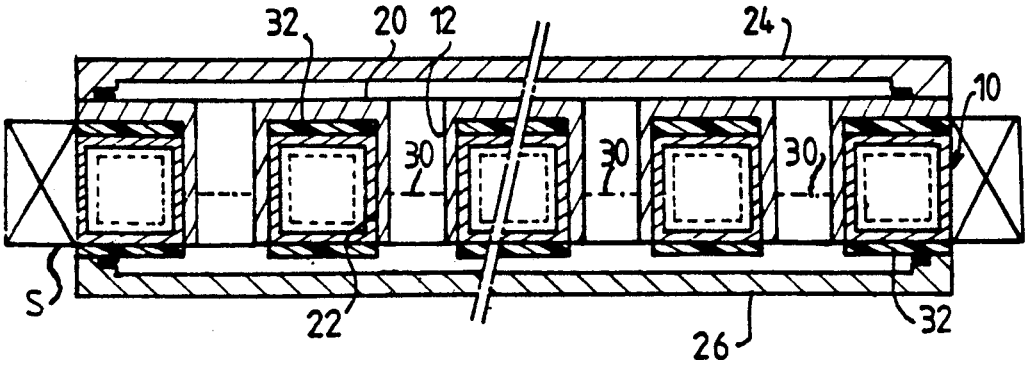
FIG. 3 is a diagrammatic section through an essential portion of the FIG. 2 apparatus.

FIG. 3 is a more detailed diagrammatic section view of the essential portion of this apparatus in operation.

FIG. 3 shows cylindrical tubes 12 each containing a filter membrane 30, the tubes 12 being received in the passages 22 passing through the enclosure 10, and the caps 24 and 26 are mounted in sealed manner respectively on the plate 20 carrying the tubes 12 and on the bottom wall of the enclosure 10. Plates or sheets 32 of thermally insulating material perforated to coincide with the passages 22 are interposed between the top and bottom walls of the enclosure 10 and the corresponding one of the plate 20 and the bottom cap 26.

The fluid used in the apparatus of the invention may be "Freon" (registered trademark), for example, which has the required characteristics.

The coating of material which may be porous or fibrous and which ensures capillary flow of the liquid inside the enclosure 10 may be a sintered material, for example, which is wettable by the liquid and which is used in conventional manner in the refrigeration industry.

The enclosure 10 is made of material which withstands pressure variations (which are about 15% on either side of a mean pressure for temperature variations in the range 0° C. to 100° C.), and the material may either be a good conductor of heat such as brass so as to obtain optimal transfer of heat with the external source S, or else a thermally insulating material in order to reduce transfers of heat via the top and bottom faces 16 and 18 of the enclosure. In the first case, the faces 16 and 18 of the enclosure are provided with thermal insulation whereas in the second case heat transfer means are provided passing through the peripheral wall of the enclosure.

Figure 4:
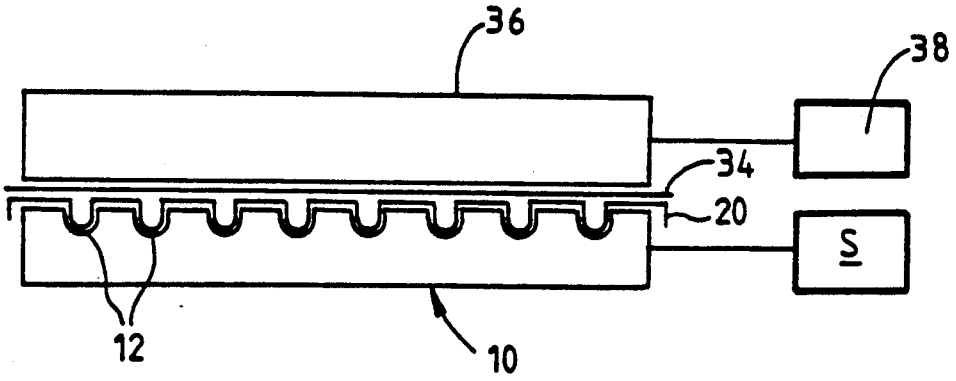
FIG. 4 is a diagram showing a variant embodiment of the apparatus.

In the variant embodiment shown diagrammatically in FIG. 4, the apparatus comprises an enclosure 10 of the above-mentioned type associated with an external heat source S and receiving wells or tubes 12 in cavities in its top face, with the top ends of the tubes 12 being carried by a common plate 20. This plate 20 is covered by a film 34 of impermeable material which closes the wells or tubes 12. A heating or cooling cap 36 covers the plate 20 and is associated with temperature regulation means 38 for maintaining its temperature substantially equal to that of the tubes 12.

Naturally, the cap 36 may also be constituted by an enclosure of the same type as the enclosure 10 and associated with the same source S.

The number of tubes 12 carried by the plate 20 may be relatively large (e.g. and in conventional manner 96 tubes organized as 8 rows by 12 columns) and the tubes 12 may be integrally molded with the plate 20.

The apparatus of the invention may be used with a single external heat source of the reversible type or else it may be used with two switchable heat sources, one hot and the other cold.

In practice, the apparatus of the invention is associated with a computer-controlled robot which disposes samples to be treated together with possible reagents or additives in the tubes 12, which places the plate 20 carrying the series of tubes 12 on the enclosure 10, which optionally displaces said enclosure from one heat source to another, etc. By controlling the pressure at the ends of the tubes 12, it is possible to perform filter operations, dialyses, the recovery of solid material by inverting pressure differences, etc.

We claim:

1. A method for high speed temperature control of a plurality of receptacles containing biological samples, for the purpose of subjecting them simultaneously to identical thermal cycles including successive stages of predetermined temperatures and durations, said stages being separated by sudden transitions which comprises: placing the receptacles in thermal contact with a wall of a sealed closed enclosure containing a heat transfer fluid in liquid-vapor equilibrium and in thermal contact with said receptacles through the wall of the enclosure, said enclosure enabling the fluid in vapor phase to flow freely and including an internal lining for capillary flow of the fluid in liquid phase, delivering heat to or taking heat from said fluid by thermal exchange with at least one external heat source thereby maintaining, by local condensation and vaporization of the fluid inside said enclosure, the temperature of said receptacles equal to a variable reference temperature imposed by said heat source, and to vary quasi-instantaneously the temperature of the receptacles according to the variations of the reference temperature, and controlling said heat source for varying the reference temperature according to the successive stages and sudden transitions of the said thermal cycles.

2. A method according to claim 1 further comprising determining the total mass and the nature of the fluid as a function of the volume of the enclosure in such a manner that liquid-vapor equilibrium of the fluid and impregnation of the lining by the fluid in the liquid phase are maintained for all temperatures lying within a predetermined range of reference temperatures.

3. A method according to claim 1 wherein said heat source is of a reversible type, enabling the reference temperature to be increased or decreased selectively.

4. A method according to claim 1, wherein said heat source for fixing the reference temperature comprises two switchable heat sources, one for increasing the reference temperature and the other for reducing it.

5. A method according to claim 1, wherein said heat source for fixing the reference temperature comprises means for varying the vapor pressure of the fluid inside the enclosure.

6. An apparatus for high speed temperature control of a plurality of receptacles containing biological samples, for the purpose of subjecting them simultaneously to identical thermal cycles including successive stages of predetermined temperatures and durations and sudden transitions separating these stages, the apparatus comprising a sealed closed enclosure containing a heat transfer fluid in liquid-vapor equilibrium and in thermal contact with said receptacles through a wall of said enclosure, this enclosure enabling the fluid vapor phase to flow freely and including an internal lining for capillary flow of the fluid in liquid phase, at least one external heat source in thermal exchange with the fluid for maintaining, by local condensation and vaporization of the fluid in said enclosure, the temperature of the receptacles equal to a variable reference temperature imposed by said heat source, and to vary quasi-instantaneously the temperature of the receptacles according to the variations of the reference temperature, and means for controlling said heat source in order to vary the reference temperature according to the successive stages and sudden transitions of the said thermal cycles.

7. Apparatus according to claim 6, wherein said heat source is reversible, being selectively capable of supplying heat to the fluid and of taking heat from the fluid.

8. Apparatus according to claim 6, wherein said external heat source comprises two switchable heat sources.

9. Apparatus according to claim 6, wherein said heat source comprises means for varying the vapor pressure of the fluid contained in the enclosure.

10. Apparatus according to claim 6, wherein the external heat source is in thermal contact with said fluid via at least a portion of one of the walls of the enclosure, with the other walls being provided, at least locally, with thermal insulation.

11. Apparatus according to claim 6, wherein said enclosure includes parallel passages opening out to the outside and forming housings for said receptacles.

12. Apparatus according to claim 11, wherein the walls of said passages form means for transferring heat by conduction between the contents of the receptacles and the fluid contained inside the enclosure.

13. Apparatus according to claim 11, wherein one end of each of said receptacles is carried by a common transverse plate for application against one of the walls of the enclosure.

14. Apparatus according to claim 11, wherein the top ends of the receptacles are carried by a common plate and are closed by a film of impermeable material placed on said plate, the plate being mounted in the above-mentioned enclosure and being covered by a heating or cooling cap associated with temperature regulation means for maintaining its temperature at a value substantially equal to that of the receptacles.

15. An apparatus for high speed temperature control of a plurality of receptacles containing biological samples, for the purpose of subjecting them simultaneously to identical thermal cycles including successive stages of predetermined temperatures and durations and sudden transitions separating these stages, the apparatus comprising a sealed closed enclosure containing a heat transfer fluid in liquid-vapor equilibrium and in thermal contact with said receptacles through a wall of said enclosure, this enclosure enabling the fluid vapor phase to flow freely and including an internal lining for capillary flow of the fluid in liquid phase, at least one external heat source in thermal exchange with the fluid for maintaining, by local condensation and vaporization of the fluid in said enclosure, the temperature of the receptacles equal to a variable reference temperature imposed by said heat source, and means for controlling said heat source in order to vary the reference temperature according to the successive stages and sudden transitions of the said thermal cycles, said enclosure including parallel passages opening to the outside and forming housings for said receptacles, wherein said walls of said enclosure into which the ends of the passages open out are covered in sealed manner by respective caps associated with means for selectively raising and lowering the pressure of the contents of said receptacles.

16. Apparatus according to claim 15, wherein the receptacles are open at both ends and are provided with filter membranes.

* * * * *